United States Patent [19]

Kaspar

[11] 4,342,385

[45] Aug. 3, 1982

[54] ARTICLE ACTUATED COIN DISPENSING MACHINE

[76] Inventor: Arthur H. Kaspar, Box 667, Shiner, Tex. 77984

[21] Appl. No.: 104,544

[22] Filed: Dec. 17, 1979

[51] Int. Cl.[3] ..... G07F 7/06

[52] U.S. Cl. ..... 194/4 D; 133/5 R

[58] Field of Search ..... 194/4 R, 4 B–4 G; 133/2, 4 R, 4 A, 5 R; 221/107, 108

[56] References Cited

U.S. PATENT DOCUMENTS

| | | | |
|---|---|---|---|
| 1,866,716 | 7/1932 | McCormick et al. | 194/4 C |
| 2,778,368 | 11/1957 | Jaskowiak | 133/2 |
| 2,911,083 | 11/1959 | Hensley | 194/4 R |
| 3,272,299 | 9/1966 | Sollenberger | 221/108 X |
| 3,412,837 | 11/1968 | Myers | 194/4 R |
| 3,738,377 | 6/1973 | Lotspeick | 133/2 |

*Primary Examiner*—F. J. Bartuska

*Attorney, Agent, or Firm*—Gunn, Lee & Jackson

[57] ABSTRACT

A manually operated machine for dispensing coins in exchange for deposit of articles, such as cans or bottles. Various dimension checking functions and stops are shown which insure that only articles of the proper dimensions are accepted by the machine. Once the article is accepted, anti-milking devices prevent the depositor from receiving more than the correct payment for the article.

15 Claims, 15 Drawing Figures

ARTICLE ACTUATED COIN DISPENSING MACHINE

BACKGROUND OF THE INVENTION

This invention relates to the recycling of containers and, more particularly, to a machine designed to return coins to persons depositing cans or bottles. The machine would check the container to make sure a deposit should be paid for it, drop the container in a storage bin, and pay the individual his mandatory deposit fee, thus enabling the seller to service paying customers.

BRIEF DESCRIPTION OF THE PRIOR ART

While coin actuated article dispensing machines abound, there are few article actuated coin dispensing machines. Machines which give coins in exchange for paper money are not relevant because the checks performed are not similar to those needed for checking used containers.

Henry Stapleman (U.S. Pat. No. 4,132,303), "Article Actuated Coin Dispensing Closure For Article Collecting Receptacles", is directed toward a similar goal, but has completely dissimilar functions and mechanisms.

Other article inspection type machines, such as quality control type machines, are available in different lines of commerce. These machines are not, however, well adapted for simple and reliable checking of cans and bottles in the manner desired. Furthermore, they are not designed to defeat operator attempts to cheat or to milk the machine.

SUMMARY OF THE INVENTION

The invention checks various dimensions of an article while the article is rotated within a drum. The rotational force is applied through a handle and lever turned by the individual who has deposited the article. Because the depositor can be relied upon to apply a relatively large amount of force, check devices which apply pressure to the article may be utilized. Furthermore, use of a rotary type process greatly simplifies placement of the necessary internal stops and anti-milking devices.

It is an object of the present invention to provide a machine capable of checking various dimensions of articles.

It is another object of the present invention to provide an article check machine which may be manually operated.

It is yet another object of the present invention to provide a machine which does not rely upon the weight of the article checked for the energy to activate the coin dispenser.

It is yet another object of the present invention to provide a device capable of being operated by untrained individuals to return tokens in exchange for deposited articles of the proper dimensions.

It is yet another object of the present invention that the machine contain sufficient anti-milking and anti-cheating barriers to deter most attempts to milk or cheat the machine.

It is yet another object of the present invention to produce a coin dispenser means which is self-fed and which is designed to be jam proof.

DESCRIPTION OF THE PREFERRED EMBODIMENT

While the preferred embodiment described herein is the current best mode of the invention, it is not the only embodiment contemplated and is not intended as a limitation upon the invention as expressed in the claims.

Figure 1:
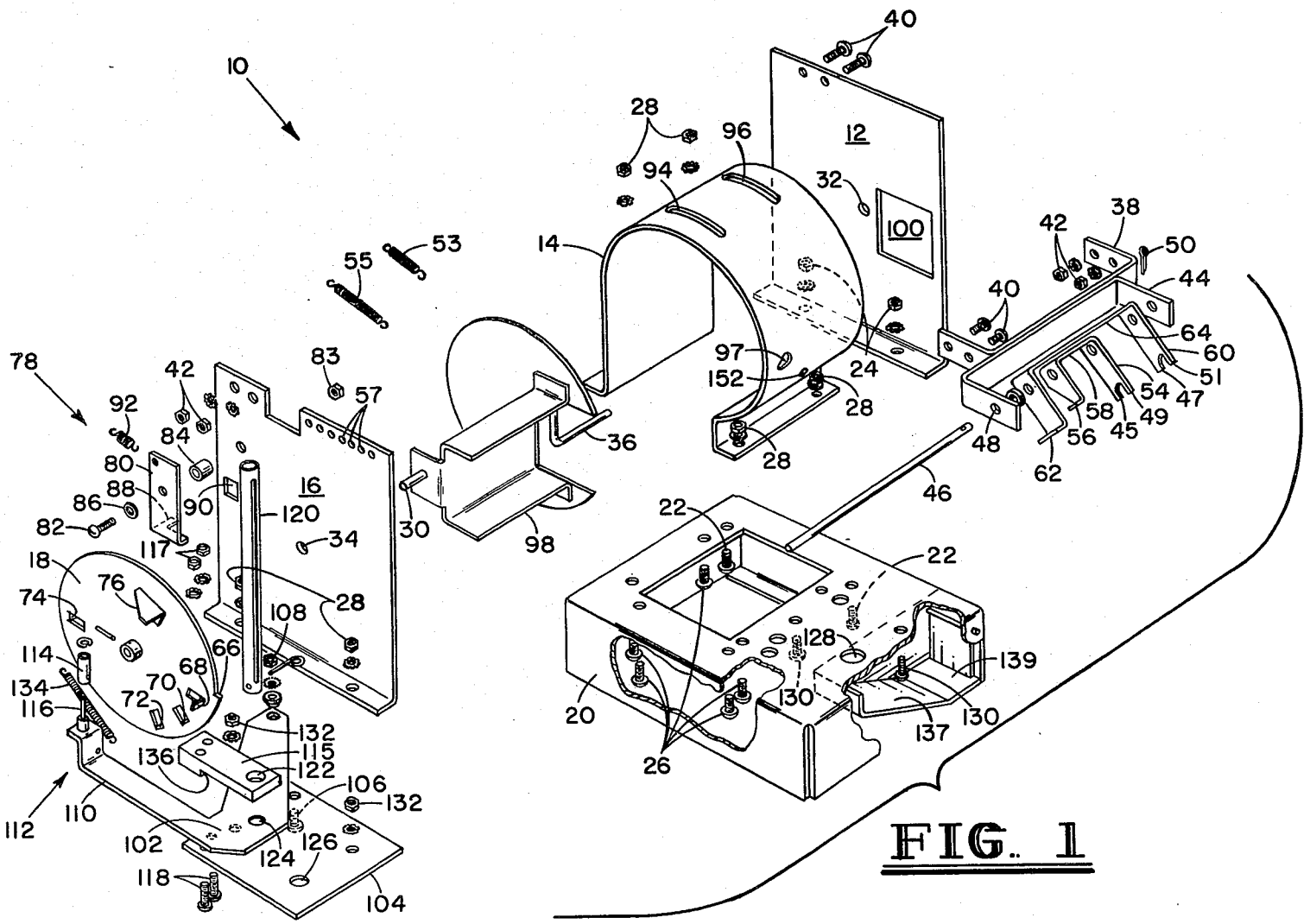
FIG. 1 is a perspective disassembled view of the invention.
Figure 5:
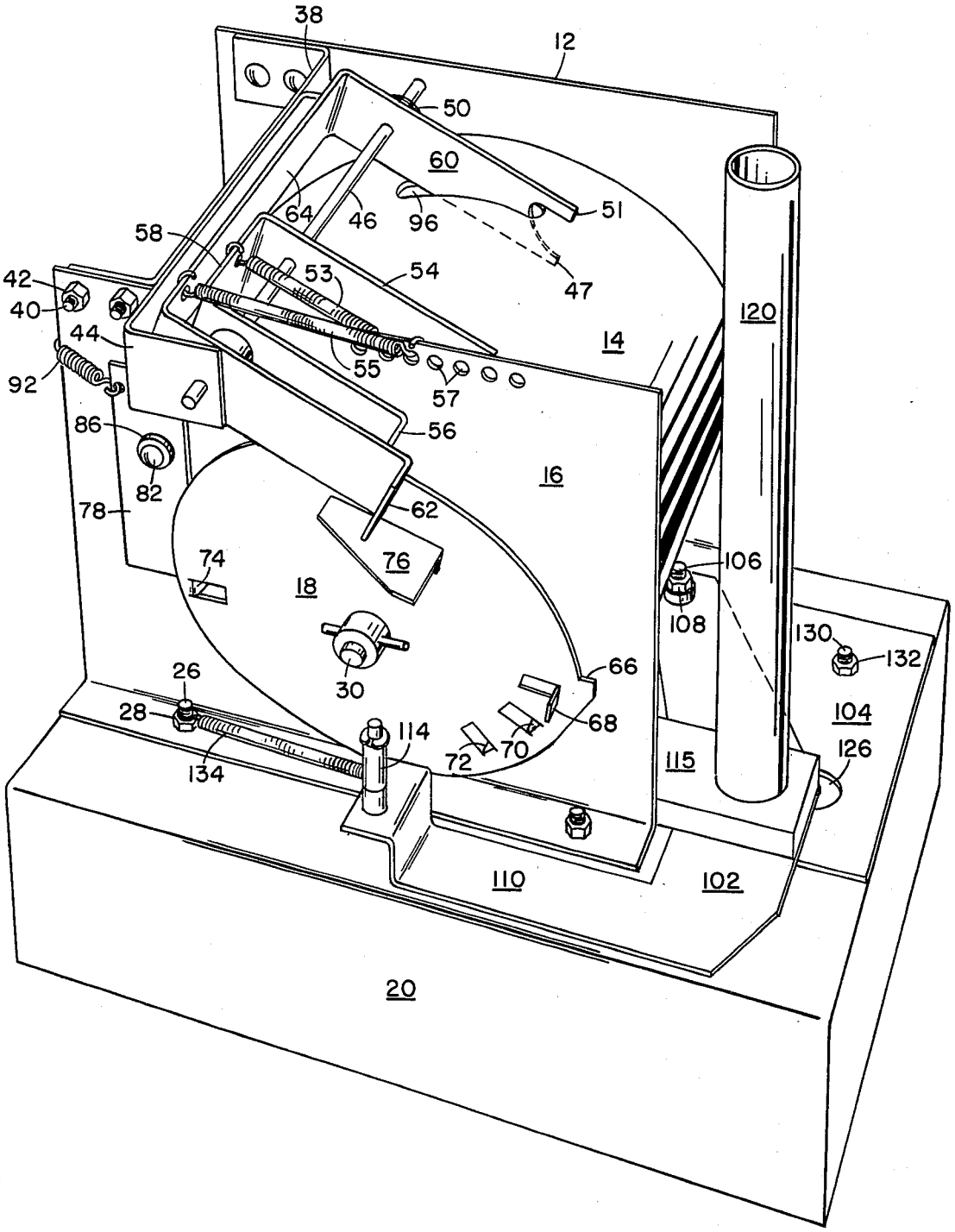
FIG. 5 is an elevated view of the rear of the invention.

FIG. 1 and FIG. 5 show the major components of the machine 10: the front housing 12, the drum 14, the rear housing 16, the disc 18, and the base 20. The front housing 12 is attached to the base 20 by bolts 22 inserted through the front housing 12 and the base 22 and fixed by nuts 24. The drum 14 and rear housing 16 are likewise fastened upon the base 22 by means of bolts 26 and nuts 28.

The main shaft 30 is located longitudinally through the drum 14 and is supported by front and rear housing shaft holes 32 and 34. A handle 36 fixed upon the forward end of the main shaft 30 enables an operator to rotate the main shaft 30. The rear end of the main shaft 30 projects through the rear housing shaft hole 34 and the disc 18 is attached thereto.

Figure 2:
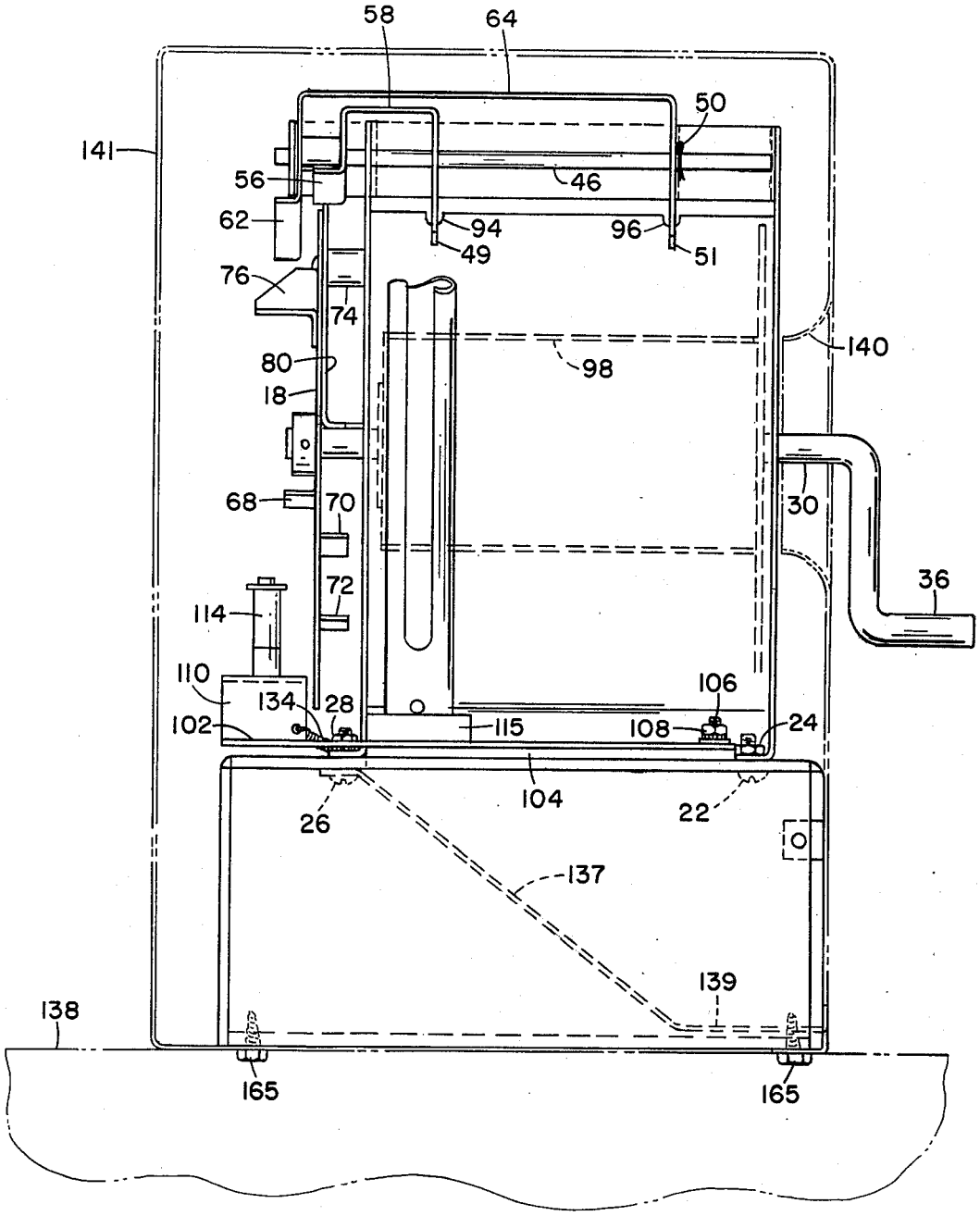
FIG. 2 is a side view of the invention in an assembled form showing the carriage in relief.
Figure 6:
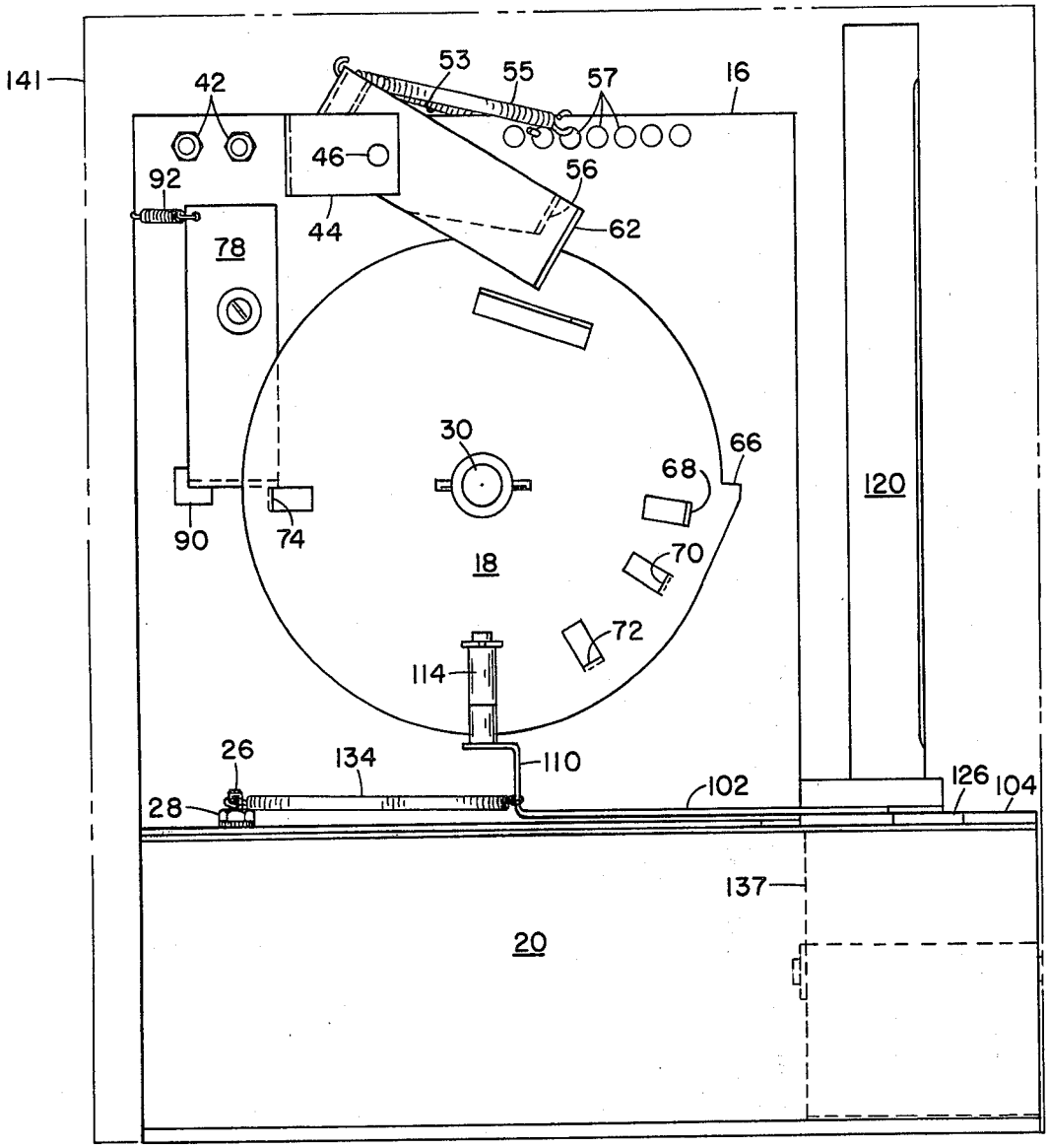
FIG. 6 is an end view of the invention showing the coin dispenser in conjunction with the second disc and a coin access slot in relief.

Located on top of the drum 14, an upper brace 38 is attached to the front and rear housings 12 and 16 by means of bolts 40 and nuts 42. A lock-out bracket 44 is fastened upon the upper brace 38 as shown in FIG. 5. The lock-out bracket 44 accommodates the lock-out shaft 46 through holes 48 and a pin 50 maintains the lock-out shaft 46 in the position as shown in FIG. 2. The first check lever 54 and first lock-out arm 56 are fashioned from a single first bar means 58 and the second check lever 60 and second lock-out arm 62 are fashioned from a single second bar means 64. Both first and second bar means 58 and 64 are rotatively retained by lock-out shaft 46. The test ends of the first and second check levers 54 and 60 consist of spikes 45 and 47 and upper supports 49 and 51, respectively. A spring 53 is attached to the first bar means 56 and a spring 55 attached to the second bar means 64. The springs 53 and 55 are also attached to one of the adjuster holes 57 located upon the rear housing 16 and serve to force the levers 54 and 60 downward through slots 94 and 96 to within the drum 14.

The disc 18 contains a lock-out notch 66 and a lock-out stop 68. First disc arm 70, second disc arm 72, and third disc arm 74 are located upon the forward face of the disc 18. The trigger activator 76 projects from the rear of the disc 18.

A reverse lock-out 78 consisting of an arm 80, upon a bolt 82, a nut 83, and a bushing 84 and held by a washer 86, is located upon the rear housing 16. The projection of a stop 88 upon the arm 80 within rear housing slot 90 limits the rotation of the reverse lock-out 78 as caused by spring 92.

First and second lock-out slots 94 and 96 are cut within the upper surface of the drum 14 such that first and second check levers 54 and 60 may fit within them as shown in FIG. 5. Additionally, an unjamming slot 97 is cut within a side of the drum to allow a caretaker to unjam articles caught upon the carriage 98.

Figure 3:
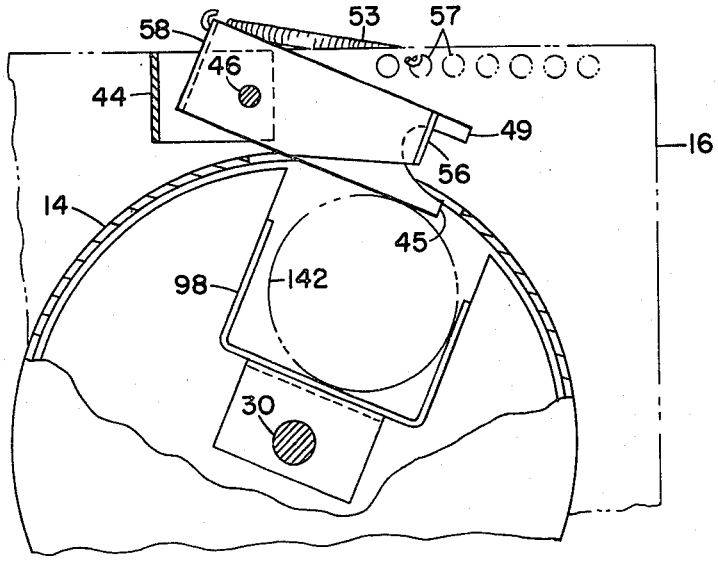
FIG. 3 is a partial cut-away view of the invention showing a check lever checking an article carried upon the carriage.
Figure 4A:
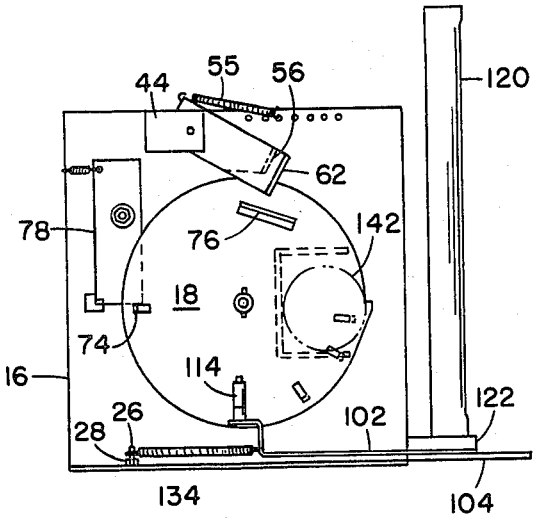
FIGS. 4(*a*), 4(*b*), 4(*c*), 4(*d*), 4(*e*), and 4(*f*) sequentially show the relative positions of the disc, a lock-out arm, a check lever, the trigger actuator and the trigger, and additionally showing in relief the relative positions of the carriage and article during the article acceptance process.
Figure 4B:
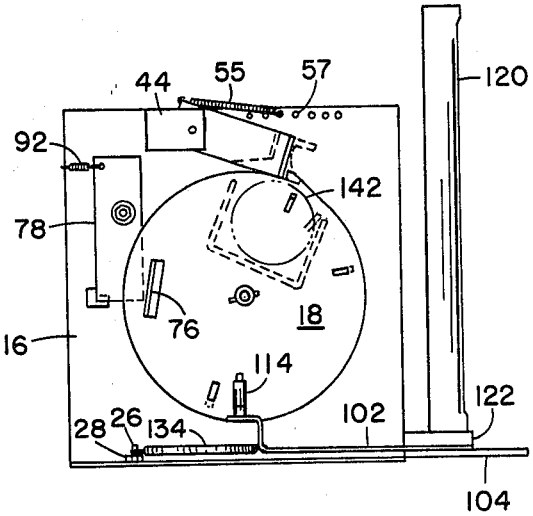
Figure 4C:
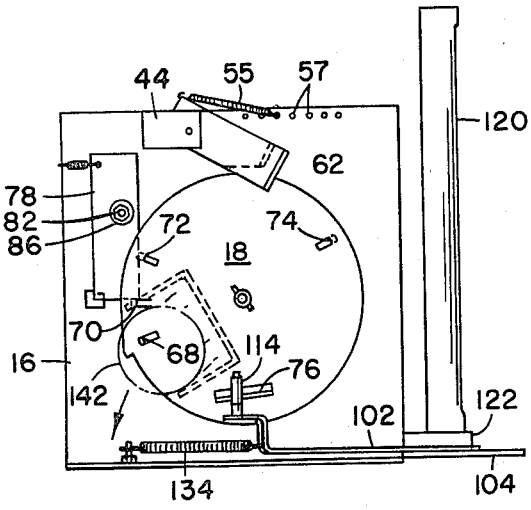
Figure 4D:
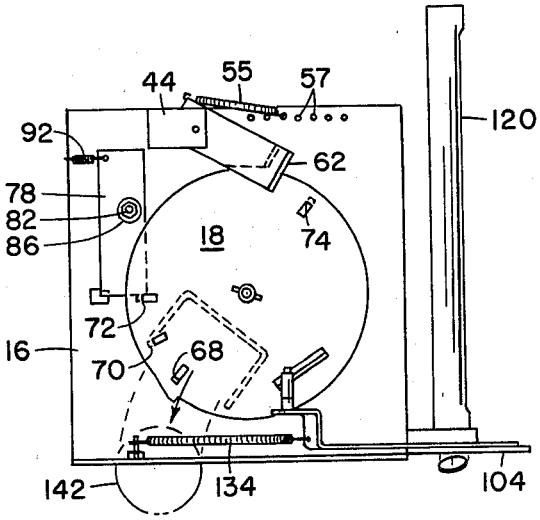
Figure 4E:
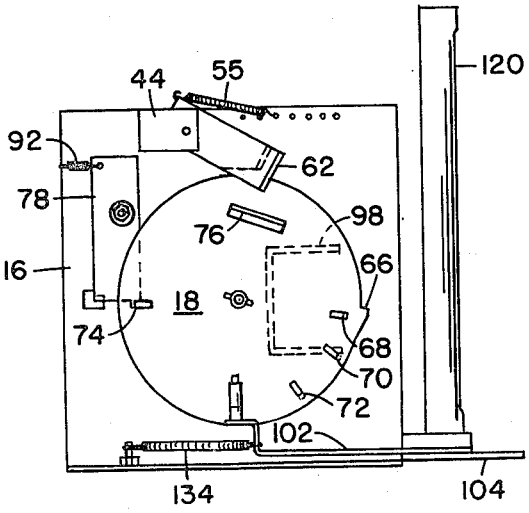
Figure 4F:
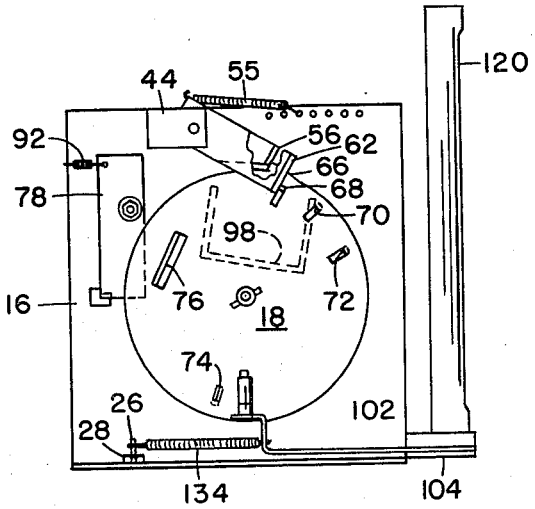

Carriage 98 is located within the drum 14 and upon the main shaft 30 as shown in FIG. 3. An article opening 100 to allow for insertion of an article upon the carriage 98 is found within the front housing 12 as shown in FIG. 1.

The thickness of coin eject plate 102 is approximately the same as the thickness of the denomination coin intended to be used with the coin eject plate 102 and it is rotatively attached to coin eject base 104 by means of bolt 106 and nut 108. The coin eject arm 110 supports a trigger 112 consisting of a bushing 114 upon pin 116. The trigger 112 lies in the path of the trigger actuator 76. The trigger actuator 76 therefore forces the coin eject plate 102 to move away from the disc 18 upon clockwise rotation of the trigger activator 76 against the trigger 112.

Coin tube holder 115 is fixed upon the coin eject base 104 by nuts 117 and bolts 118. The outer surface of the lower end of the coin tube 120 is sized to fit within the hole 122 in the coin tube holder 115 without slipping through it. The coin tube holder hole 122, the coin eject plate hole 124, the coin eject base hole 126, and the base coin hole 128 are all sized to be larger than the size coin they are expected to accommodate. The coin eject base 104 is fixed upon the base 20 by bolts 130 and nuts 132. A spring 134 attached to the coin eject arm 110 and bolt 26 operates to pull the coin eject plate 102 flush against the lower face of the coin holder 136 absent any force applied by the trigger actuator 76. A coin chute 137 sloping downward toward a coin access 139 is located below the base coin hole 128.

Figure 8:
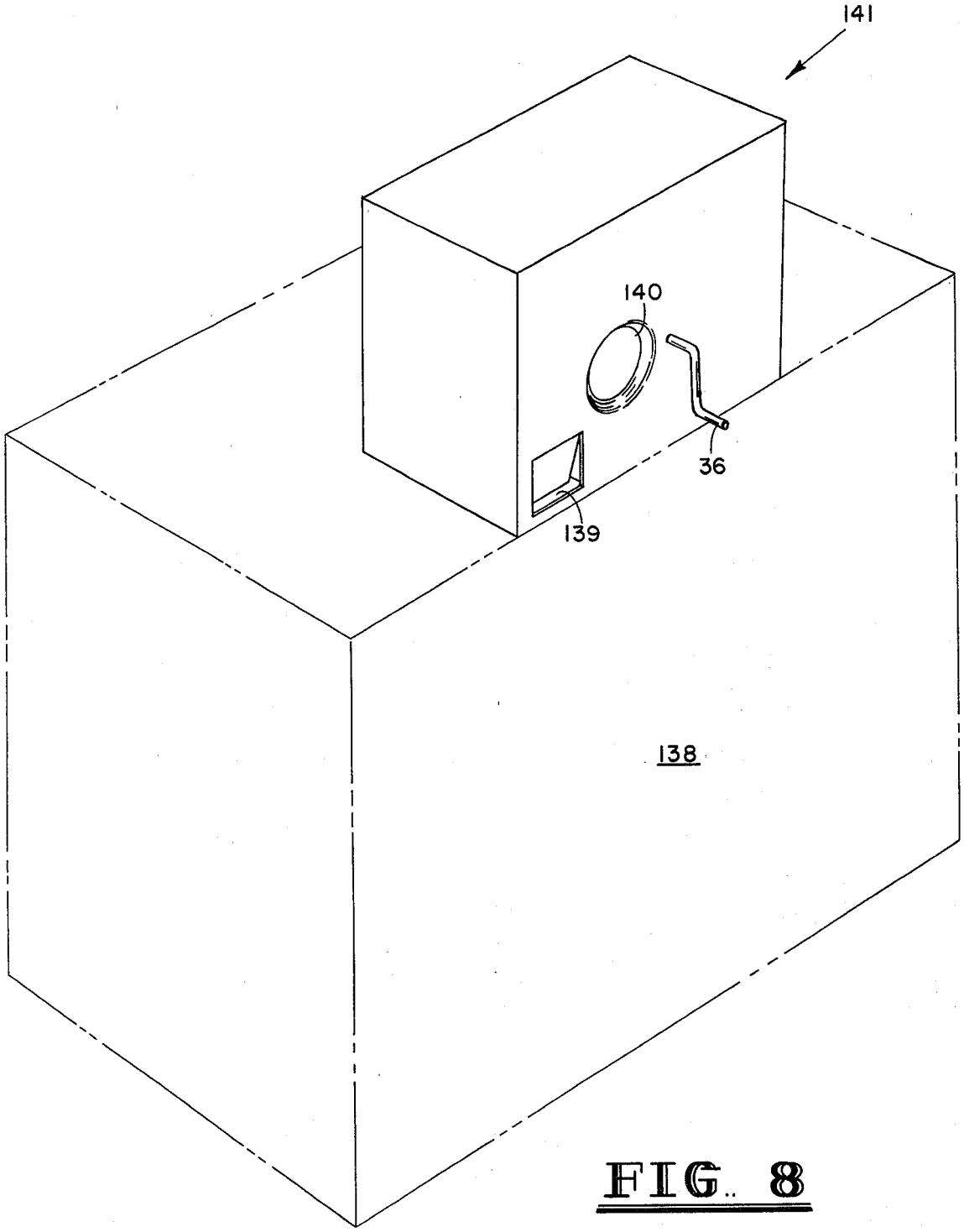
FIG. 8 is an elevated view of the article actuated machine retained within a protective display and situated upon a large article container for accepted articles.

The machine 10 is typically mounted within protective display 141 attached by bolts 165 to a large container 138 for storing received articles as shown in FIG. 8. An appropriately sized article input hole 140 allows access to the machine 10.

In operation, the operator inserts the article to be checked 142 through the article input hole 140 and through the article opening 100 and onto the carriage 98. FIG. 4(*a*) shows an end view of this position.

The operator rotates the handle 36, the main shaft 30, and all parts connected to it in a counterclockwise direction. (For the purpose of clarity, the directions of the rotation will be described throughout from the perspective of an individual standing behind the machine 10. It is understood that an identical but symmetrically opposite machine is necessarily included for all purposes.) As is shown in FIG. 4(*a*), reverse lock-out 78 fits against the third disc arm 74 to prevent the operator from rotating the article 142 in a clockwise direction in an attempt to "milk" the machine 10.

After rotating the article 142 from in front of the article opening 100 to approximately a 1:00 o'clock position, the article 142 is positioned to be checked as is shown in FIGS. 3 and 4(*b*). The spikes 45 and 47, when combined with the action of springs 53 and 55, push against the outer surface of the article 142 with a predetermined amount of pressure. If the article 142 is not strong enough to force both check levers 54 and 60 up, the lock-out arms 56 and 62 block further rotation. Further, if the article surface is not stiff enough to avoid puncture by either spike 45 or 47, or if the surface is not smooth enough to permit them to slide across it, the article 142 will jam against them. The article of incidence and sharpness of the spikes 45 and 47 may be varied and the amount of pressure exerted by them varied by moving springs 53 and 55 along the adjuster holes 57.

If check levers 54 and 60 are forced upward by the article 142, bar means 58 and 64 are rotated about the lockout shaft 124, and the lock-out arms 56 and 62 lifted from their original positions and no longer jam against the disc lock-out notch 66 or lock-out stop 68 to prevent further counterclockwise rotation.

Figure 7A:
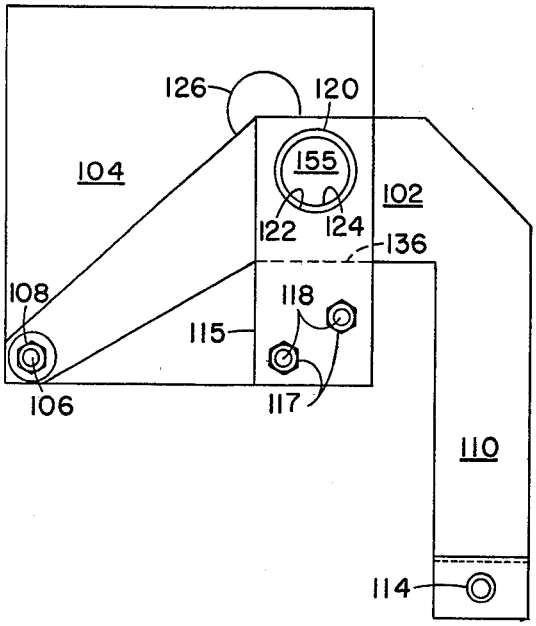
FIG. 7(*a*), 7(*b*), and 7(*c*) sequentially show vertical views of the coin dispenser for the different possible positions of the coin eject plate.
Figure 7B:
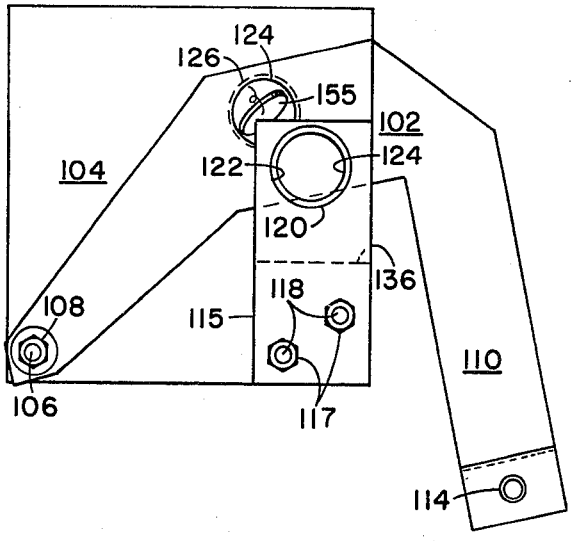
Figure 7C:
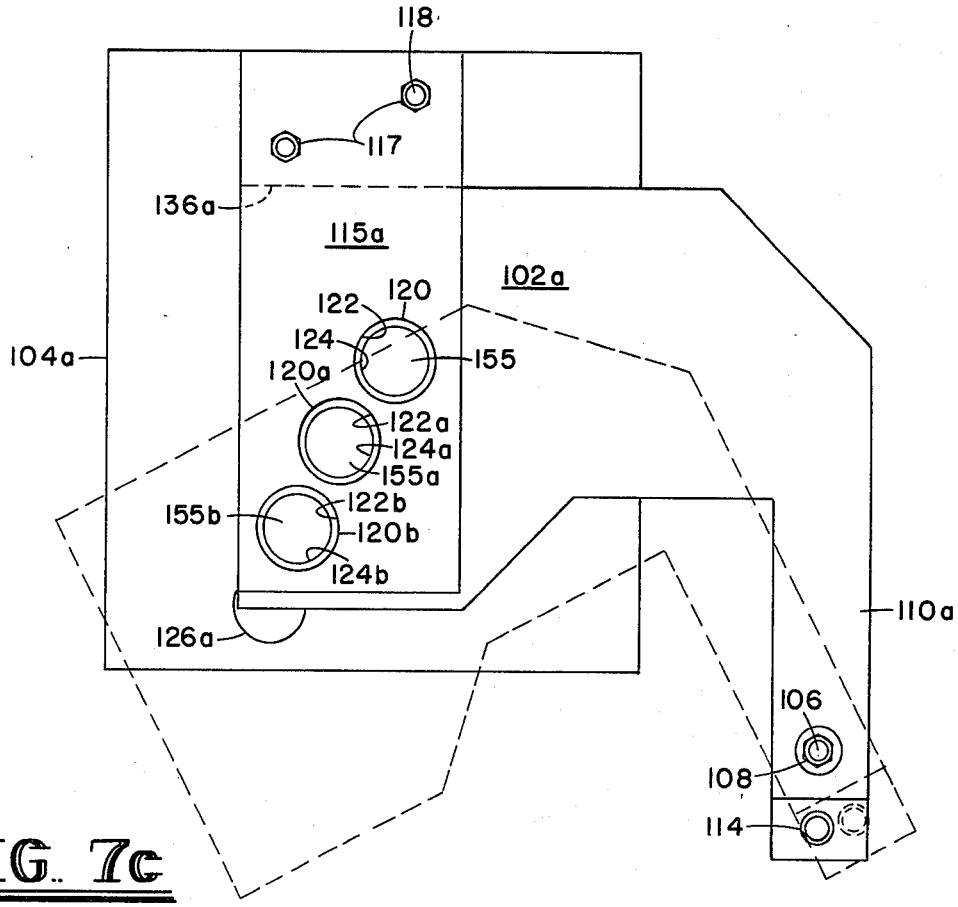

Upon further counterclockwise rotation of the article 142 to an approximate 9:00 o'clock position, the first disc arm 72 contacts and outwardly displaces the reverse lock-out 78 and the outer sloped edge of the trigger actuator 76 contacts and begins to displace the trigger 112. At the 8:00 o'clock position, the first disc arm 72 moves beyond the reverse lock-out 78 and reverse lock-out 78 returns to its normal position thus blocking any clockwise motion. At the 7:00 o'clock position, the trigger 112 and coin eject plate 102 are so far rotated about bolt 106 as shown in FIG. 7(*b*) that the coin within coin eject plate hole 124 falls through the coin eject base 104, down the coin chute 137, and to the coin access 139. Attempts by the operator to cheat the machine by returning for other coins by clockwise rotation is impossible because of the interference of the reverse lock-out 78 with the first disc stop 70. Any further counterclockwise rotation moves the second disc stop 72 past the reverse lock-out 78 and the trigger actuator 76 past the trigger 112 allowing spring 134 to return the coin eject plate 102 to its original position flush against the lower face of the coin tube holder 136 as shown in FIG. 7(*a*) and where another coin falls from the coin tube 120 into the coin eject plate hole 124. The article simultaneously falls from the carriage into the storage area 138 of the protective display 141 as shown in FIG. 4(*d*).

FIG. 4(*f*) shows lock-out arms 56 and 62 abutting against lock-out notch 66 and lock-out stop 68, respectively, in the case of an attempt to cheat the machine by rotating the shaft 30 in a counterclockwise direction without placing an article 142 or a satisfactorily sized article within the carriage 98.

FIG. 7(*c*) shows a method of using multiple coin tubes 120, 120(*a*), and 120(*b*) to increase the coin storage capacity of the machine 10. The additional tubes 120(*a*) and 120(*b*) are located upon the coin eject plate hole 124 arc. Coin eject plate 102(*a*) is sufficiently large to remain under all coin tubes 120, 120(*a*) and 120(*b*) at all times. If the coin eject plate hole 124 is empty when it passes beneath a coin tube containing coins, a coin will drop into the coin eject plate hole 124. If the coin tube is empty or if a coin is already within the coin eject plate hole 124, the hole 124 will pass beneath the coin tube without effect.

An additional means of assuring that article 142 drops from the carriage is utilization of a stripper bolt fastened upon the inside of the drum 14 at stripper bolt hole 152.

The stripper bolt projects into the carriage 98 and prevents further counterclockwise rotation until the article 142 falls from the carriage 98. This is necessary to avoid attempts to cheat the machine by affixing the deposited article 142 within the carriage 98. Further, the machine 10 has been designed so that its moving parts are located upon the outside of the drum and are thus easily accessible for inspection and repair.

It is additionally contemplated that the machine may be designed and constructed to be operable in a nonrotary or a linear fashion. In these alternative versions of the invention, similar openings, checks, and stops are used as are described in the rotary version above. Location of these elements to effectively function in nonrotary or linear versions of the invention will be apparent to those who read the above description and are skilled in the art.

It is thus seen that eight separate and cooperating checks are performed upon the article 142 prior to the operator receiving a coin 155. If an article will not fit between the front rear housings 12 and 16, it is too long. If it will not fit through the article opening 100, it is too wide. If it is not long enough to lift both check levers 54 and 60 simultaneously, it is too short. If it is not wide enough at two points a set distance apart to sufficiently lift the check levers 54 and 60, it is too narrow. If its outer surface is insufficiently stiff enough to repel the spikes 45 and 47, if the overall article is insufficiently strong to resist crushing by the check levers 54 and 60, or if the surface is too rough to permit spikes 45 and 47 to slide over it under pressure, the article will not be accepted for payment. Springs 53 and 55 may be varied in tension, the spikes 45 and 47 varied in sharpness, and the number, reach, and lateral placement of the check levers 54 and 60 varied as may be deemed practicable.

A manually operated article checking machine having for checking eight article characteristics, having anti-milking functions and having a coin dispenser as an integral part thereof has been shown. While the invention has been described in connection with the preferred embodiment, it is not intended to limit the invention to the particular forms set forth, but, on the contrary, it is intended to cover such alternatives, modifications, and equivalents as may be included within the spirit and scope of the invention as defined by the appended claims.

I claim:

1. A machine for dispensing coins in response to receipt and checking of an article belonging to a defined class of acceptable articles comprising:

a housing having an article opening from an outside of said housing to an interior of said housing, said article opening being sized to permit passage therethrough of acceptable said articles;

said housing prevents operator access to within said housing except through said article opening;

said article opening closely receives said acceptable articles and prevents insertion of articles substantially larger than acceptable articles;

a rotatable shaft positioned through said interior of said housing and projecting through said housing to said outside of said housing and having a handle fixed upon said shaft projection, said shaft being rotatable along its longest axis both in a first direction and in a second direction, said second direction being the reverse of said first direction;

a carriage adapted for carrying said articles located within said interior of said housing to receive said articles through said article opening when in a carriage original position, fixed upon said shaft and rotatable within said interior of said housing upon rotation of said shaft;

at least one shaft stop connected to said shaft, movable in response to rotation of said shaft and arranged to prevent further rotation of said shaft, said carriage, and said article when movement of said shaft stop is halted;

moveable first stop means located adjacent to said shaft stop means when in an original first stop means position to stop rotation of said shaft, said carriage, and said article in a first direction by halting movement of said shaft stop and located to allow further rotation of said shaft, said carriage, and said article in said first direction by allowing movement of said shaft stop means when in a subsequent first stop means position;

check means comprising at least two moveable probes for checking said article upon said article being placed through said article opening to within said interior of said housing and within said carriage, said article being rotated in said first direction to contact said probes by rotating said shaft, said probes being located within said housing and positioned to check said article along at least two portions of said article for article width and to collectively check for a minimum article length and to permit further rotation of said article in said first direction if the article width and length measured by said probes are within the set of acceptable article widths and lengths, by moving said first stop means to said subsequent second stop means position;

at least one of said probes maintained in place by a predetermined amount of force for checking said article for article strength and article surface rigidity by only moving said first stop means from said original position to said subsequent position in response to checking a said article having acceptable surface strength and rigidity; and a testing end of at least one of said probes sufficiently pointed to check said article for article surface resistance to penetration by only moving said first stop means from said original position to said subsequent position in response to checking a said article having a surface acceptably resistant to penetration, second stop means located to stop rotation of said shaft in said second direction by halting movement of said carriage at at least one shaft stop;

location and arrangement of said trigger means to prevent triggering except upon sufficient rotation of an acceptable article within said carriage machine in said first direction, a dump opening from said inside of said housing to said outside of said housing sized to permit passage therethrough of said articles from said carriage to said outside of said housing, said dump opening being located to allow dumping of said articles only after said articles have been determined by said probes to be acceptable articles, said carriage and said shaft being further rotatable to allow movement of said carriage and said shaft to said carriage original position after said article has been dumped through said dump opening;

trigger means adapted for triggering a coin dispensing means in response to sufficient rotation of said shaft means in said first direction; and said machine being operable to dispense coins in return for collection of an acceptable article through the efforts of a human operator manually inserting an acceptable article and manually rotating said shaft by means of said handle.

2. The machine of claim 1 additionally being operable solely through the efforts of a human operator and having a handle connected to said carriage means for manually supplying sufficient rotational force to said carriage means to operate said machine.

3. A machine for activating a trigger means upon receipt of an article belonging to a defined class of acceptable articles which comprises:

a housing;

an article opening in said housing for receiving said articles;

carriage means adapted for carrying said articles, said carriage means being located within said housing for receiving said articles through said article opening and rotatable within said housing;

first stop means located to engage said carriage means to stop rotation of said carriage means in a first direction at at least one selected point;

moveable check means located within said housing for checking at least one width of said article and for disengaging said first stop means from said carriage means if said article is determined by said check means to be within said defined class of acceptable articles;

trigger means operable in response to sufficient rotation of said carriage means in said first direction;

at least two movable probes for testing said article, said probes being located within said housing and arranged to test said article along at least two portions of said article for article width and to test at least one portion of said article for article length; and means for disengaging said first stop means if the article widths and length measured by said probes are within the set of acceptable article widths and lengths of the defined class of articles;

said probes maintained in place by a predetermined amount of force for checking said article for article surface strength and article surface rigidity by said check means not disengaging said first stop means unless said article is strong enough and rigid enough to communicate sufficient force against said probes to sufficiently displace said probes; and a testing end of at least one of said probes sufficiently pointed to test the surface of said article for resistance to penetration and adapted to prevent articles having insufficient resistance to penetration by the pointed probe from being rotated past the pointed probe;

said carriage means being mounted upon a shaft means positioned through said housing, said shaft being rotatable along its longest axis both in a first direction and in a second direction, said second direction being the reverse of said first direction;

at least one first blocking member connected to said shaft means and adapted to rotate about said shaft means upon rotation of said shaft means;

a movable first stop arm of said first stop means which first stop arm obstructs the rotary path of and halts rotation of said first blocking member at at least one selected point;

said first stop arm being removable from the rotary path of said first blocking member to disengage from said first stop means to permit free rotational movement in said first direction by said shaft means;

at least one second blocking member connected to said shaft means and adapted to rotate about said shaft means upon rotation of said shaft means; and a movable second stop arm of said second stop means which second stop arm halts the rotational movement in a second direction of said shaft means by obstructing the rotation of said second blocking member at at least one selected point.

4. The machine of claim 3 wherein said first stop means operates by jamming against said carriage means.

5. The machine of claim 3 additionally including anticheat means comprising:

second stop means located adjacent to said shaft means to stop rotation of said shaft means at at least one selected point;

said housing additionally prevents operator access to said carriage except through said article opening;

said article opening closely receives articles of said defined class of articles for preventing insertion of articles wider than desired;

said carriage means and said housing are designed and constructed to cause removal of said article from said carriage during rotation of said carriage to prevent multiple activation of said trigger means through the use of a single article; and said selected positions of halting said first direction and said second direction rotation of said carriage are selected to prevent multiple activation of said trigger means through rotation of a single article in either said first direction or said second direction within said machine.

6. The machine of claim 5 additionally comprising:

at least one disc located upon said shaft means, said first block member, said second block member, and having a trigger activator for operating said trigger means located upon said disc.

7. The machine of claim 5 wherein said housing comprises at least a front housing and a drum means, said shaft means positioned axially through said drum means and being rotatable through said front housing and said carriage means being contained entirely within said drum means.

8. The machine of claim 5 additionally comprising coin dispensing means connected to said trigger means for dispensing coins in return for deposit of an article of the defined class of articles.

9. The machine of claim 5 additionally comprising a protective display covering and an article storage container for storing articles accepted by said machine.

10. The machine of claim 5 wherein said check means, said first stop means, said second stop means, said trigger activator, said trigger means, and said coin dispensing means are located to be accessible from the outside of said housing for facilitating inspection and repair of said machine.

11. A machine for activating a trigger means upon receipt of an article belonging to a defined class of acceptable articles which comprises:

a housing;

an article opening in said housing for receiving said articles;

carriage means adapted for carrying said articles, said carriage means being located within said housing for receiving said articles through said article opening and movable within said housing;

first stop means located to engage said carriage means to stop movement of said carriage means in a first direction at at least one selected point;

movable check means located within said housing for checking at least one width of said article and for disengaging said first stop means from said carriage means if said article is determined by said check means to be within said defined class of acceptable articles;

trigger means operable in response to sufficient movement of said carriage means in said first direction;

at least two movable probes for testing said article, said probes being located within said housing and arranged to test said article along at least two portions of said article for article width and to test at least one portion of said article for article length; and means for disengaging said first stop means if the article widths and length measured by said probes are within the set of acceptable article widths and lengths of the defined class of articles;

said probes maintained in place by a predetermined amount of force for checking said article for article surface strength and article surface rigidity by said check means not disengaging said first stop means unless said article is strong enough and rigid enough to communicate sufficient force against said probes to sufficiently displace said probes;

a testing end of at least one of said probes sufficiently pointed to test the surface of said article for resistance to penetration and adapted to prevent articles having insufficient resistance to penetration by the pointed probe from being rotated past the pointed probe; and said pointed probe positioned to direct said point of said pointed probe at an opposing angle to movement of said article in said first direction to penetrate any said article of insufficient surface strength, surface rigidity or surface smoothness.

12. The machine of claim 11 additionally comprising a coin dispensing means comprising:

a base plate having a base hole, said base hole having a diameter larger than the diameter of the coin to be dispensed;

an eject plate rotatively connected to said base plate and having an eject hole, said eject hole being located within said eject plate such that said eject hole is centered above said base hole at at least one rotational position of said eject plate and having a diameter larger than the diameter of the coin to be dispensed and having a depth approximately equal to the thickness of the coin to be dispensed;

a first coin tube for holding coins located above the eject plate such that said first coin tube is centered above said eject hole at at least one rotational position of said eject plate other than when said eject hole is centered above said base hole;

a trigger connected to said eject plate so that upon proper movement of said trigger said eject plate transports a coin from beneath said first coin tube to above said base hole by means of said eject hole such that said coin drops through said base hole; and power means for returning said eject plate to beneath said first coin tube so that a coin may drop from said first coin tube and into said eject hole.

13. The coin dispensing means of claim 12 additionally comprising at least one additional coin tube, said additional coin tube being located adjacent to said first coin tube and distally from said base hole so that it is centered above said eject hole at at least one rotation position of said eject plate and may drop coins from said additional coin tube to within said eject hole when the supply of coins within said first coin tube is exhausted.

14. A machine for activating a trigger means upon receipt of an article belonging to a defined class of acceptable articles which comprises:

a housing:

an article opening in said housing for receiving said articles; carriage means adapted for carrying said articles, said carriage means being located within said housing for receiving said articles through said article opening and movable within said housing;

first stop means locate to engage said carriage means to stop movement of said carriage means in a first direction at at least one width of said article and for disengaging said first stop means from said carriage means if said article is determined by said check means to be within said defined class of acceptable articles;

trigger means operable in response to sufficient movement of said carriage means in said first direction;

at least two movable probes for testing said article, said probes being located within said housing and arranged to test said article for article width and to test at least one portion of said article for article length; and means for disengaging said first stop means if the article widths and length measured by said probes are within the set of acceptable article widths and lengths of the defined class of articles;

said probes maintained in place by a predetermined amount of force for checking said article for article surface strength and article surface rigidity by said check means not disengaging said first stop means unless said article is strong enough and rigid enough to communicate sufficient force against said probes to sufficiently displace said probes;

a testing end of at least one of said probes sufficiently pointed to test the surface of said article for resistance to penetration and adapted to prevent articles having insufficient resistance to penetration by the pointed probe from being rotated past the pointed probe; and said pointed probe positioned to direct said point of said pointed probe at an oposing angle to movement of said article in said first direction to penetrate any said article of insufficient surface strength, surface rigidity or surface smoothness.

15. The machine of claim 14 additionally including anti-cheat means comprising:

second stop means located adjacent to said shaft means to stop rotation of said shaft means at at least on selected point;

said housing additionally prevents operator access to said carriage except through said article opening;

said article opening closely receives articles of said defined class of articles for preventing insertion of articles wider than desired;

said carriage means and said housing are designed and constructed to cause removal of said article from said carriage during rotation of said carriage to prevent multiple activation of said trigger means through the use of a single article; and said selected positions of halting rotation of said carriage in said first direction and a second direction, said second direction being the reverse of said first direction, are selected to prevent multiple activation of said trigger means through rotation of a single article in either said first direction or said second direction with said machine.

* * * * *